US005299945A

United States Patent [19]

Norden

[11] Patent Number: 5,299,945

[45] Date of Patent: Apr. 5, 1994

[54] ELECTRICAL APPARATUS

[75] Inventor: Alexander R. Norden, Boca Raton, Fla.

[73] Assignee: Connectron, Inc., Laurence Harbor, N.J.

[21] Appl. No.: 997,515

[22] Filed: Dec. 28, 1992

[51] Int. Cl.[5] ..... H01R 13/62

[52] U.S. Cl. ..... 439/157; 439/152

[58] Field of Search ..... 439/152–160, 439/409–411, 338, 339, 341, 372

[56] References Cited

U.S. PATENT DOCUMENTS 3,061,761 10/1962 Blain ..... 439/153
4,497,528 2/1985 Murtland ..... 439/160
4,869,681 9/1989 Vache et al. ..... 439/341
4,900,096 2/1991 Bujtas et al. ..... 439/157
4,995,821 2/1991 Casey ..... 439/157
5,010,426 4/1991 Krenz ..... 439/157
5,065,004 11/1991 Mizuno et al. ..... 439/153

*Primary Examiner*—David L. Pirlot

[57] ABSTRACT

A plug-in terminal block is driven into a companion receptacle and drawn out of the receptacle by an actuator pivoted to the receptacle. The actuator, having driven the plug-in block into the receptacle, is in its blocking position, blocking the plug-in block against removal from the receptacle and blocking insertion of a terminal block into the receptacle. A locking device locks the actuator in its blocking position. The actuator is accessible for operating the locking device and for tilting the actuator via the door opening of an enclosure.

21 Claims, 3 Drawing Sheets

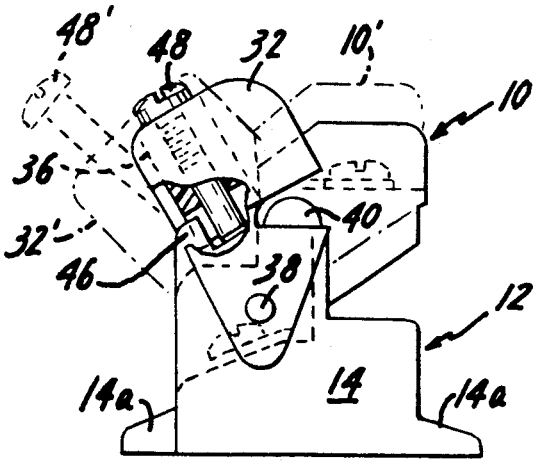
FIG.1
FIG.4
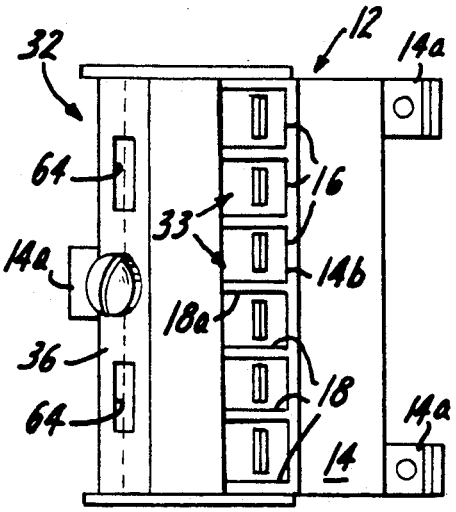
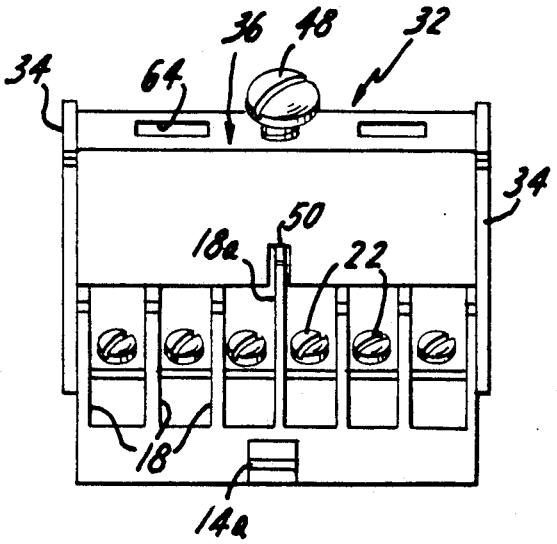
FIG.3
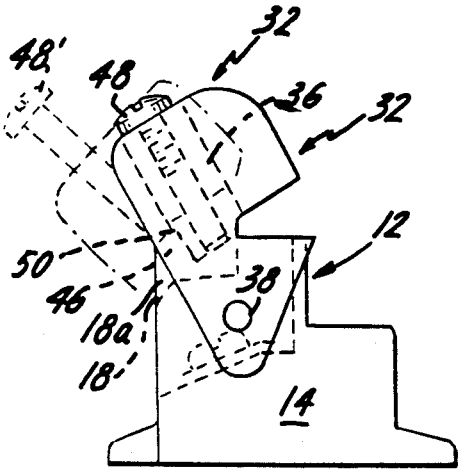
FIG.2
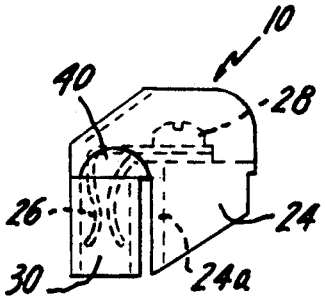
FIG.5
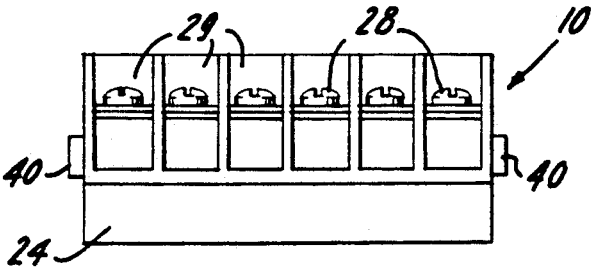
FIG.6

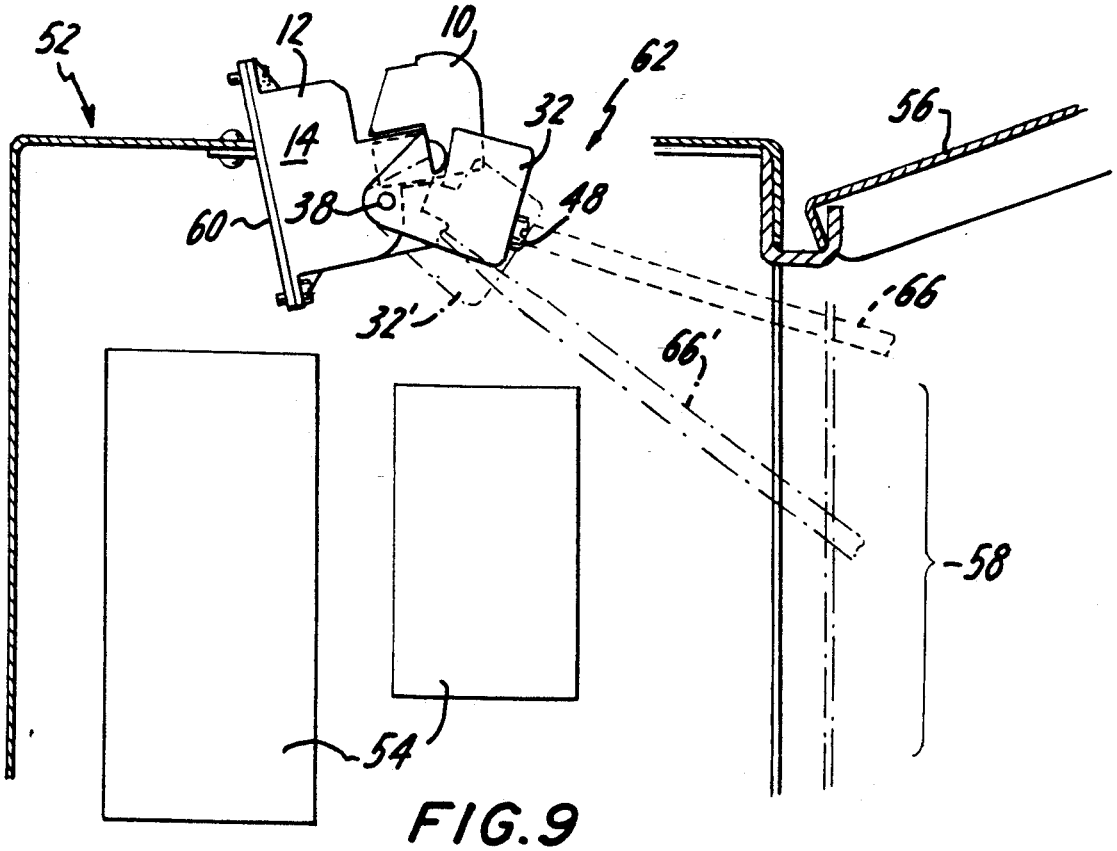
FIG. 9
FIG. 7
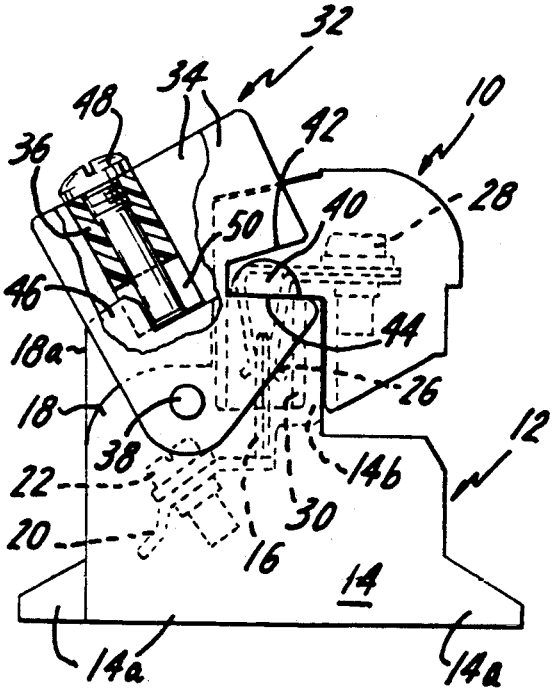
FIG. 8
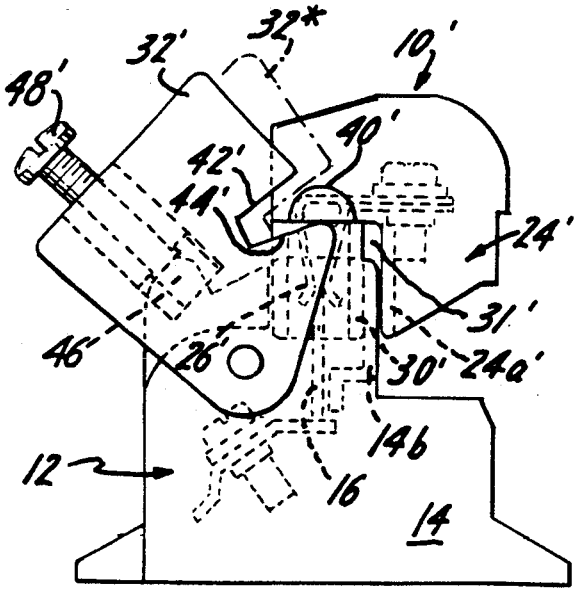

ELECTRICAL APPARATUS

The present invention relates to Plug-in connectors or terminal blocks, and to electrical apparatus incorporating plug-in terminal blocks.

BACKGROUND

Plug-in connectors have long been used for disconnecting and reconnecting groups of wires, for interrupting and then reconnecting two pieces of electrical apparatus. The connections commonly include energizing circuits, control circuits and monitoring circuits, extending between what may be called "a main electrical unit" and a secondary electrical unit. In an example, the main electrical unit may be a motor control center, and the secondary unit may be the controlled and monitored unit.

In normal operation, the terminal blocks are in their plugged-in condition. The main electrical unit commonly includes a main switch or a circuit breaker or fuses, for turning on power to the secondary unit and for interrupting the power when a fault occurs. There are times when the plug-in terminal blocks are pulled apart, as for safely working on the secondary equipment.

Plug-in terminal blocks contain mating or companion contacts that commonly develop large amounts of friction where they engage and disengage each other. Cam levers are often used for making it easy to plug-in and extract one plug-in terminal-block from a companion terminal block. Resilient detents are occasionally used for increasing the force needed to unplug one connector from the other, to reduce the risk of accidental disconnection.

SUMMARY OF THE INVENTION

Novel plug-in connectors include a plug-in terminal block and a receptacle; an actuator is pivoted to the receptacle. The actuator is coupled to the plug-in terminal block by a cam follower and cams that drive the plug-in terminal block into and out of the receptacle.

In two forms of the novel apparatus, a locking device secures the actuator in its position holding the plug-in terminal block plugged into the receptacle, blocking its path of removal from the receptacle. The same locking device holds the actuator in position blocking insertion of a plug-in terminal block into an empty receptacle. This is the "blocking" position or condition of the actuator.

With the plug-in block-plugged into its companion receptacle in the primary apparatus, the secondary apparatus is in condition for operation and for some tests to-be-performed. Locking the plug-in block plugged into the receptacle gives positive assurance against the plug-in block becoming accidentally dislodged. However, unlike a detent, the provision of a locking device does not add to the force needed to plug-in or remove a plug-in terminal block. The locking device requires deliberate manipulation, consequently adding a measure of assurance against a person casually unplugging the plug-in connector. In turn, another person conducting tests of the wiring can be confident that the plugged-in condition of the connector is in effect.

The locking device serves yet another purpose. When the locking device locks the actuator in its blocking position and if the receptacle is empty, a person can proceed safely to test the wires extending from the unplugged plug-in terminal block. Locking the actuator in its blocking position prevents another person, acting casually, from plugging-in the plug-in terminal block; assurance is provided that wires which should not be energized, actually are deenergized. A person not aware of tests being performed on the wiring, on seeing a plug-in terminal block unplugged, might be tempted to plug it into the receptacle. However, the locked condition of the actuator provides clear notice that the blocking position of the actuator is purposeful.

In one form of the apparatus, the locking device is incorporated in the plug-in connector; in another form, the locking device is provided by coaction of the actuator with the door of an enclosure in which the plug-in connector is mounted.

The preferred locking device involves a screw which, when in its locking position, is opposite to an obstruction on the receptacle. In this position, the screw locks the actuator in position blocking the path of insertion of a plug-in block into the receptacle and blocks the path of removal of a plug-in block from the receptacle.

The exemplary novel plug-in terminal block, as described in detail below and shown in the drawings, is mounted in an enclosure with the screw head accessible to a screwdriver whose axis is along a line through a door opening of an enclosure. In addition, a cavity is provided in the actuator for coaction with a screwdriver that acts as a lever extension of the actuator, in that-way making it easier to plug in and remove a plug-in terminal block. Still further, for greatest benefit, both the cavity and the screw head are accessible along axes that extend along lines extending through a door opening of an enclosure. The actuator, the cams and the cam follower are proportioned so that the required operation of a screwdriver is only about 30° in moving the actuator between its blocking condition and its position releasing the plug-in block for removal and insertion.

The nature of the invention will be more fully appreciated from the following detailed description of an exemplary embodiment and a modification which are shown in the accompanying drawings. It will be understood that further modifications of those embodiments of the invention will be readily devised by those skilled in the art, so that the appended claims should be construed broadly within the true spirit and scope of the invention.

BRIEF DESCRIPTION OF THE DRAWINGS

FIG. 1 is a reduced-scale end view of a novel terminal block assembly embodying aspects of the invention, including a plug-in terminal block plugged into a receptacle and a cam actuator for the plug-in block, portions being broken away and shown in cross-section and parts in broken lines representing the assembly in the unplugged condition of the plug-in terminal block;

FIG. 2 is an end view like FIG. 1 of the assembly of FIG. 1, omitting the plug-in block;

FIG. 3 is a view looking toward the left-hand side of FIG. 1, this figure also being a left-hand side view of FIG. 2;

FIG. 4 is a top plan view of the receptacle and the cam actuator of FIGS. 1 and 2, looking down on FIG. 2;

FIG. 5 is an end view of the plug-in block that forms part of the assembly of FIG. 1;

FIG. 6 is a side view of the plug-in terminal block of FIGS. 1 and 5 as seen from the right of FIG. 5;

FIG. 7 is a view like FIG. 1, drawn to larger scale, portions being broken away and portions being shown in cross-section;

FIG. 8 is a view like FIG. 7 in the released condition of the assembly;

FIG. 9 is a somewhat diagrammatic view of motor control apparatus including an enclosure partly in cross-section, also including the novel terminal block assembly of FIGS. 1–8, illustrating additional aspects of the invention.

DETAILED DESCRIPTION OF AN ILLUSTRATIVE EMBODIMENT OF THE INVENTION

Figure 10:
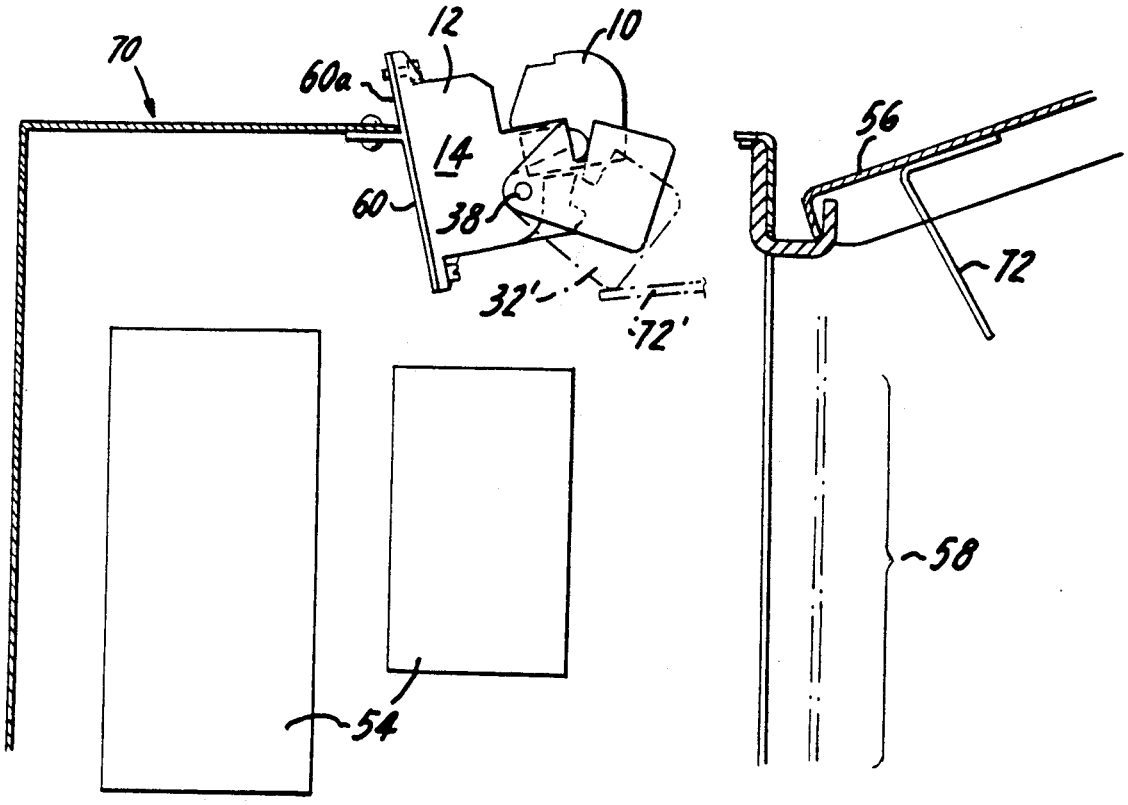
FIG. 10 is a somewhat diagrammatic view of a modification of the apparatus in FIG. 9.

In the drawings, FIGS. 1–8 show a novel terminal block assembly and FIG. 9 shows the assembly of FIGS. 1–8 as part of motor control apparatus. FIG. 10 represents a modification of FIG. 9.

Plug-in terminal block 10 (FIGS. 5–8) includes a body 24 of molded insulation containing female plug-in contacts 26. Each contact 26 comprises portions of two resilient metal strips extending to terminal screw 28. The plug-in assembly shown is a six-pole device; each pole of the plug-in block comprises a contact 26 and a wire fastener including screw 28. Interphase barriers 29 of insulation are integral portions of molded block 24. A square tube 30 of insulation surrounds each plug-in contact 26, tubes 30 being portions of body 24. Tubes 30 are open at one end to admit a companion contact of the receptacle.

Receptacle 12 includes a block 14 of molded insulation, divides into six poles corresponding to the six poles of the plug-in terminal block 10. Receptacle 12 has six contacts 16 (to mate with contacts 26) flanked by interphase barriers, including barriers 18 and a distinctively shaped barrier 18*a*. Each pole of receptacle 12 includes a contact 16, a metal strip 20 mechanically locked in place in block 14, and a wire fastener including screw 22. Receptacle 12 has conventional mounting formations designated 14*a*, being diagrammatically shown in FIGS. 1–9.

Two main components of the terminal block assembly are plug-in terminal block 10 and receptacle 12.

The third main constituent of the terminal block assembly of FIGS. 1–4, 7 and 8 is a cam member 32, also called an "actuator". Cam member 32 comprises a pair of end panels 34 and a bridge portion 36; these are integral portions of one component of molded insulation in this example. A pivot 38 projecting integrally from each end of body 14 of receptacle 12 is received in a hole in each end panel 34.

A cam follower 40 projects as an integral portion of body 24 at each end of plug-in terminal block 10. In the plugged-in condition of the assembly (FIG. 7), a cam 42 of each panel 34 overlies cam follower 40, and a second cam 44 is disposed under cam follower 40. As shown here, cams 42 and 44 of each end panel 34 are the edges of a notch in that panel. Each pair of cams 42, 44 diverges from the inner end of the notch that forms the cams. These cams are straight, but they may be suitably curved.

The assembly of FIGS. 1–4, 7 and 8 includes a provision for locking the actuator 32 in its "blocking" position. In this position, actuator 32 is effective to hold a plug-in terminal block 10 securely plugged into the receptacle. Additionally, when the receptacle is empty, actuator 32 blocks the path of insertion of a plug-in terminal block.

The means for locking the actuator in its blocking position, in this example, includes abutment 46 and screw 48. Abutment 46 is an integral projection of interphase barrier 18*a*, and screw 48 is carried by bridge 36 of actuator 32. When screw 48 is unscrewed (FIG. 81 and the dotted lines in FIGS. 1 and 2), the actuator is free to swing about its pivot 38. To accommodate this movement, the abutment portion 46 of interphase barrier 18*a* is received in slot 50 in bridging portion 36 of actuator 32.

When actuator 32 is in its blocking position (as represented in solid lines in FIGS. 1 and 2), screw 48 may be tightened, bringing its lower end into position opposite to abutment 46 (FIG. 7). The head of screw 48 may be tight against member 32. When screw 48 is tightened, it is retained securely in the position of FIG. 7. Actuator 32 is in its "locked" position when the lower end of screw 48 is opposite to abutment 46.

The configuration of the parts, as shown in FIGS. 7 and 8, develops considerable mechanical advantage that promotes easy operation of actuator 32. A relatively small force applied to cam actuator 32 develops much greater force both for extracting a plug-in terminal block 10 from the receptacle and for driving a plug-in block 10 into the receptacle.

Components in FIG. 8, when shifted from their positions of FIG. 7 bear primed numerals. In the configuration of the parts shown in solid lines in FIG. 8, cam 44′ is below and in engagement with cam follower 40′. This is the condition of the parts at the end of a stroke of the cam member or actuator for extracting plug-in block 10′ from the receptacle. The plug-in block 10′ is then readily removable. Actuator 32 is then in its unblocking condition. This is also the condition of the assembly when a plug-in block 10 has been placed in preliminary assembly to the receptacle, i.e., opposite to and partway into the receptacle, with plug-in contacts 26′ near but not touching contacts 16 of the receptacle.

Plug-in block 10 is guided into receptacle 12 so that, as block 10 is being inserted into receptacle 12, contacts 26 are aligned with contacts 16 and then mate properly. Molded body 24 of the plug-in block has integral rectangular tubes 30 containing contacts 26, and there is a space 31 between tubes 30 and wall 24*a* of body 24. Molded body 14 has an integral wall 14*b* that is received in space 31 so as to be guided by tubes 30 and wall 20*a*. In addition, wall 14*b* and interphase barriers 18 and 18*a* form rectangular cavities 33 that receive and guide tubes 30.

As actuator 32 is moved clockwise from its position shown in solid lines in FIG. 8, it reaches the position 32* shown in broken lines. Cams 42′ overlie and bear against respective cam followers 40′. Further effort applied clockwise to member 32 is converted mainly into a force that drives the plug-in block into plugged-in assembly to the receptacle as shown in FIG. 7.

Counterclockwise operation of actuator 32 from its position shown in FIG. 7 unplugs or extracts or ejects the plug-in terminal block 10 from receptacle 12.

FIG. 9 shows the connector or plug-in terminal block assembly 10, 12, 32 of FIGS. 1–8 installed in an enclosure 52. The enclosure in this example is part of a typical motor control center. Its walls enclose the usual components 54 such as energizing transformers and fuses, and the main switching devices, and other customary components of a motor control center. Hinged door 56 provides access through door opening 58 to the enclosed apparatus.

The receptacle 12 of plug-in terminal block assembly 10, 12, 32 is fixed by brackets 60 and 60a to enclosure 52 at opening 62. Wiring (not shown) to secondary apparatus extends from the screw fasteners of plug-in terminal block 10. The motor control apparatus in enclosure 52 commonly includes an interlock (not shown) that holds door 56 shut so long as the switching device is "on". Some or all of the wiring connected to terminal block 10 may be energized so long as the terminal block is in its receptacle. Opening 62 in the enclosure provides access for inserting and removing a plug-in block 10.

Bridge 36 of actuator 32 has a pair of cavities 64 (FIGS. 3 and 4) for snugly receiving the blade or wedge-like end portion of a screwdriver 66 or any suitable and conveniently available tool to serve as an operating lever. This tool can be shifted between its position 66 and its position 66' (FIG. 9) for shifting actuator or cam member 32 in FIG. 9 between its position 32 and its position 32', for operating the actuator in the manner described above in connection with FIGS. 1–8. Actuator 32 bas a stroke of roughly 30° for driving plug-in block 10 into its operative position in the receptacle, and for extracting the plug-in block. Such a limited angular stroke is a clear benefit in apparatus such as that of FIG. 9, where there is only limited room for tilting the axis of screwdriver 66.

So long as door 56 remains closed, a screwdriver cannot reach actuator 32 to change its condition, whether in the assembly 10, 12, 32 of FIG. 1 that includes the plug-in block, or in the assembly 12, 32 of FIG. 2. Moreover, so long as the door remains closed, screw 48 is inaccessible to release its locking effect. Consequently, maintenance of the connections provided by assembly 10, 12, 32 is assured so long as door 56 remains closed. Correspondingly, all circuits that might be energized by terminal block 10 must remain deenergized so long as plug-in block 10 (with its wiring) is not in receptacle 12. So long as the door remains closed, actuator 32 is inaccessible and the condition of the wiring to plug-in block 10 (whether unplugged or plugged-in) cannot be changed.

After door 56 has been opened, screw 58 becomes accessible for operation to unlock the actuator 32, and cavities 64 of the actuator 32 become accessible for operation by an inserted tool. Screw 48 and cavities 64 are engageable by the end of a screwdriver from the same vantage point.

Plug-in terminal block 10 is directly engageable for removal at opening 62 of the enclosure. However, as already noted, when screw 48 has been tightened in its locking position opposite abutment 46 (FIG. 1) removal of a plug-in terminal block 10 from receptacle 12 is prevented; and with actuator locked in its solid-line position of FIG. 2, insertion of a terminal block 10 into receptacle 12 is prevented. The provision of the locking means 46, 48 adds assurance to a person who may be testing or otherwise working on the wiring from plug-in terminal block 10, that the condition of the plug-in connector 10, 12 is as intended, whether energized or deenergized. Deliberate effort must be applied to unlock actuator 32 for changing the condition of plug-in connector 10, 12.

FIG. 10 is a somewhat diagrammatic view of a modification of the apparatus of FIG. 9. The same numerals are used for the same parts in both figures; the description is not repeated for so much of FIG. 10 as is the same as in FIG. 9. Cavities 64 of FIG. 4 are provided in the actuator 32 of FIG. 10 for receiving a screwdriver as in FIG. 9, to help in removing a plug-in block from the receptacle. The plug-in terminal block of the assembly of FIG. 10 also has a screw 48 and a cooperating abutment 46 for locking actuator 32 in its blocking position. However, screw 48 is not shown in FIG. 10; it may be omitted inasmuch as its purpose is served partially by bracket 72, described below.

Enclosure 70 in FIG. 10 is modified as compared with enclosure 52, to support assembly 10, 12 closer to the door opening than in-FIG. 9. Additionally, a bracket 72 is fixed to door 56. The bracket is located so that, as the door swings closed, it assumed a position 72' (represented in broken lines) where the bracket engages the actuator in the "unblocking" position of actuator 32' shown in FIG. 8.

As the closing motion of the door is completed, bracket 72 drives actuator 32' to its position 32 represented in FIG. 10 in solid lines. Actuator 32-is then in its blocking position. If a plug-in block 10 had been plugged into receptacle 12, it is blocked by actuator 32 against being removed, and if no plug-in terminal block is present in the receptacle when the door-closing motion is completed, actuator 32 blocks entry of a plug-in block.

Actuator 32 assumes its blocking position when door 56 has been closed. Afterward, when the door is opened, actuator 32 remains in its blocking position. In FIG. 10, the axis of pivot 38 is vertical so that there is no tendency of actuator 32 to move out of its blocking position. A resilient detent (not shown) may be provided for holding actuator 32 in its blocking position after the door is opened and bracket 72 is withdrawn.

When a technician works on secondary apparatus connected by wiring that extends to plug-in terminal block 10, the technician may choose either to have plug-in block 10 in the receptacle or to remove plug-in block 10 from the receptacle. In either case, the technician should have assurance that the chosen condition is not altered casually by another person. The assurance is provided by bracket 72'; by closing door 70, the technician forces the actuator into its blocking position. The actuator in that position blocks both the path of insertion of a plug-in block and the path of removal of a plug-in block. If the door were opened, whether by the technician or another, the actuator would remain in its blocking position. Only the technician should lever the actuator out of that position.

Using both the locking screw 48 and bracket 72, together, doubles the safe condition of actuator 32. If the technician tightens screw 48 after first moving the actuator to its blocking position, the actuator is retained in its blocking position whether the door is oven or closed. If the screw is not tightened and if the actuator is in its unblocking position, closing the door automatically forces the actuator into its blocking position.

The nature of the invention will be appreciated from the foregoing detailed description of a presently preferred embodiment and modification shown in the drawings. Further modification may readily be made by those skilled in the art, in the light of the above disclosure of the invention.

I claim:

1. Electrical apparatus including

I.) an enclosure having an access opening,

II.) a terminal block assembly in said enclosure including i.) a plug-in block having plug-in contacts and a first insulating unit carrying said plug-in contacts, ii.) a receptacle having receptacle contacts for mating engagement with said plug-in contacts when the plug-in block has been driven into the receptacle, said receptacle having a second insulating unit carrying said receptacle contacts, iii.) a pivot on said second insulating unit, iv.) an actuator supported by said pivot, said actuator having an integral forward-driving cam and an integral reverse-driving cam, said actuator including said cams constituting a unitary member operable in arcuate forward and reverse driving strokes about said pivot, v.) said first insulating unit of the plug-in block having integral driven portions engaged, respectively, by said forward-driving cam and said reverse-driving cam in the forward and reverse arcuate strokes of the actuator between an initial position and an end position, thereby to drive the plug-in block from an insertion position opposite to the receptacle to a plugged-in position in the receptacle, and reversely from said plugged-in position to said insertion position, vi.) said terminal block assembly being adapted for placement of said plug-in block in said insertion position or removal therefrom when the forward-driving cam is at the start of its forward-driving stroke, vii.) said forward-driving cam when in its position at the end of said forward-driving stroke (a) blocking the plug-in block, when in the receptacle, against being removed and (b) when the receptacle in empty, blocking the plug-in block against being plugged into the receptacle, III.) Said electrical apparatus additionally including a releasable locking device for locking said actuator in its end position where it blocks the plug-in block against being plugged into the receptacle and against being removed therefrom, said actuator being operable in said forward and reverse strokes when the locking device is released, and IV.) a door for closing said access opening, said actuator being accessible within the enclosure and being operable via said access opening in forward and reverse strokes while the door is open, said door while closed blocking access to said actuator.

2. A terminal block assembly including:

i.) a plug-in block having plug-in contacts and a first insulating unit carrying said plug-in contacts, ii.) a receptacle having receptacle contacts for mating engagement with said plug-in contacts when the plug-in block has been driven into the receptacle, said receptacle having a second insulating unit carrying said receptacle contacts, iii.) a pivot on said second insulating unit, iv.) an actuator supported by said pivot, said actuator having an integral forward-driving cam and an integral reverse-driving cam, said actuator including said driving cams constituting a unitary member operable in arcuate forward and reverse driving strokes about said pivot, v.) said first insulating unit of the plug-in block having integral driven portions engaged, respectively, by said forward-driving cam and said reverse-driving cam of the actuator in its arcuate forward and reverse driving strokes between an initial position and an end position, thereby to drive the plug-in block from said insertion position opposite to the receptacle to a plugged-in position in the receptacle, and reversely from said plugged-in position to said insertion position, vi.) said terminal block assembly being adapted for placement of said plug-in block in said insertion position or removable therefrom when the forward-driving cam is at the start of its forward-driving stroke, vii.) said forward-driving cam when positioned at the end of its forward driving stroke (a) blocking the plug-in block, when in the receptacle, against being removed and, (b) when the receptacle is empty, blocking the plug-in block against being plugged into the receptacle, viii.) said terminal block assembly additionally including a releasable locking device carried by the actuator and cooperating with a stop on the receptacle for locking said actuator in its position at the end of said forward-driving stroke, said locking device being operable for releasing said actuator for operation in forward and reverse strokes between said initial and end positions.

3. A terminal block assembly as in claim 2, wherein said actuator has a cavity for cooperatively receiving an end portion of a tool for enabling the tool to apply leverage to drive the actuator about its pivot.

4. A terminal block assembly as in claim 2, wherein said assembly is proportioned so that the driving stroke of the actuator extends through an angle of roughly 30° in shifting said plug-in block between said initial position and said end position.

5. A terminal block assembly as in claim 2, wherein said locking device, after having released said actuator for operation, assumes a stable unlocking position and is free of means tending to return it to its actuator-locking condition.

6. A terminal block assembly as in claim 2, wherein said locking device is a screw-threaded member having a head rotatable by a tool in operative engagement with said head for operating the screw-threaded member between its locking and released positions.

7. A terminal block assembly as in claim 6, wherein said actuator has a cavity for cooperatively receiving an end portion of a tool for enabling the tool to apply leverage to drive the actuator about its pivot.

8. A terminal block assembly as in claim 2, wherein said screw-threaded member has an axis extending essentially in the same direction as an elongated tool having an end portion cooperatively receivable in said cavity.

9. A terminal block assembly as in claim 8, wherein said assembly is proportioned so that the driving stroke of the actuator extends through an angle of roughly 30° in shifting said plug-in block between said initial position and said end position.

10. Electrical apparatus including an enclosure having an access opening, a terminal block assembly including a receptacle having receptacle contacts, a plug-in block having plug-in contacts and an actuator pivoted to said receptacle and operable in arcuate forward and reverse driving strokes for driving the plug-in block into the receptacle and for reversely driving the plug-in block out of the receptacle, thereby to drive said plug-in contacts into and out of mating engagement with the receptacle contacts, said actuator being disposed in the enclosure for being operated via said access opening, and said enclosure having a door for closing said access opening and blocking operating access to said actuator, said actuator having forward and reverse driving portions for driving said plug-in block into and out of the receptacle, said actuator including said driving portions constituting a unitary member, said terminal block assembly being formed for placement of the plug-in block in, and removal of the plug-in block from, insertion position of the plug-in block opposite to the receptacle in condition to be driven into the receptacle by said forward driving portion of the actuator, whereby said forward-driving portion at the end of said forward driving stroke (a) blocks the plug-in block, when in the receptacle, against being removed and (b) blocks the plug-in block against being inserted into the receptacle when the latter is empty, said apparatus additionally having a device for locking said actuator in said end position for thereby maintaining the plug-in block in the receptacle or out of the receptacle, said locking device being releasable for enabling the actuator to be operated back and forth to its initial position and to its end position via said access opening while the door remains open and while the locking device is released.

11. Electrical apparatus as in claim 10, wherein said locking device, when locking the actuator in its blocking position, acts between said actuator and a portion of a stationary structure that comprises the enclosure and the receptacle for preventing the actuator from being moved out of its blocking position.

12. Electrical apparatus as in claim 10, wherein a wall of said enclosure has a wiring opening at which said receptacle is fixed in position for a plug-in block to be assembled to the receptacle and for removal of the plug-in block from the receptacle, the receptacle having wire fasteners that are connected to said receptacle contacts and that are accessible only within the enclosure and the plug-in block having wire fasteners that are connected to said plug-in contacts and that are accessible outside the enclosure.

13. Electrical apparatus as in claim 10, wherein said locking device, after having released said actuator for operation, assumes a stable unlocking position and is free of means tending to return it to its actuator-locking condition.

14. Electrical apparatus as in claim 10, wherein said actuator and said locking device are inside the enclosure and are readily operable via said access opening.

15. Electrical apparatus as in claim 10, wherein said locking device, when locking the actuator in said blocking position, acts between the actuator and the enclosure.

16. Electrical apparatus as in claim 5, wherein said locking device is a member operable by said door for locking the actuator in its blocking position when the door is closed.

17. Electrical apparatus as in claim 10, wherein said locking device acts between the actuator and the receptacle for locking the actuator in its blocking position.

18. Electrical apparatus as in claim 17, wherein the locking device is a screw-threaded member having at one end thereof a head disposed to be engaged and rotated by an elongated tool having an axis extending through said opening for locking and releasing the actuator when in its blocking position.

19. Electrical apparatus as in claim 17, wherein said actuator has a cavity for receiving an end portion of an elongated tool for operating said actuator about its pivot between said initial position and said and position, and wherein the locking device is a screw-threaded member carried by said actuator and having a head engageable by the end of an elongated tool that is rotatable about an axis, each of said cavity and said head being disposed for coaction with such elongated tool while the axis of the tool extends through said access opening of the enclosure.

20. Electrical apparatus as in claim 10, wherein said actuator has a cavity for cooperation with a tool insertable therein via said access opening for operating said actuator about its pivot so as to drive said plug-in block between its released position and its operative position.

21. Electrical apparatus as in claim 20, wherein said actuator is operable through an angle of roughly 30° between its released position and its operative position.

* * * * *